US005497890A

United States Patent [19]

Clark

[11] Patent Number: 5,497,890

[45] Date of Patent: Mar. 12, 1996

[54] PLASTICWARE RETAINER FOR USE IN AN AUTOMATIC DISHWASHER

[75] Inventor: Gary W. Clark, Lagrange, N.C.

[73] Assignee: White Consolidated Industries, Inc., Cleveland, Ohio

[21] Appl. No.: 179,486

[22] Filed: Jan. 7, 1994

[51] Int. Cl.[6] ..... A47G 19/08

[52] U.S. Cl. ..... 211/41; 211/181; 211/198; 248/499

[58] Field of Search ..... 211/41, 71, 74, 211/181; 220/19; 248/499

[56] References Cited

U.S. PATENT DOCUMENTS

| | | | |
|---|---|---|---|
| 3,612,285 | 10/1971 | Mason . | |
| 3,752,322 | 8/1973 | Fiocca et al. . | |
| 3,934,728 | 12/1976 | Guth . | |
| 3,935,958 | 2/1976 | Frangos . | |
| 4,058,233 | 11/1977 | Frangos . | |
| 4,732,291 | 3/1988 | McConnell . | |
| 4,748,993 | 6/1988 | Llewellyn . | |
| 4,830,200 | 5/1989 | Zambano et al. . | |
| 4,917,248 | 4/1990 | Friskney | 211/41 |
| 5,114,019 | 5/1992 | Sandbank . | |
| 5,121,843 | 6/1992 | Elder . | |
| 5,201,826 | 4/1993 | Zimmermann . | |
| 5,205,419 | 4/1993 | Purtilo . | |
| 5,344,029 | 9/1994 | Oghia et al. . | |

*Primary Examiner*—Ramon O. Ramirez
*Attorney, Agent, or Firm*—Pearne, Gordon, McCoy & Granger

[57] ABSTRACT

A plasticware retainer is provided for holding lightweight articles in a dishwasher rack to prevent them from dislodging during a washing cycle. The retainer includes a plurality of perforate, generally rigid panel members and blocks for pivotally interconnecting the panel members. The panel members pivot or rotate about a longitudinal axis to generally conform to and overlie the lightweight articles in the dishwasher rack. The panel members also fully pivot or rotate to fold the retainer in an accordion-like manner for storage.

17 Claims, 2 Drawing Sheets

Fig.4
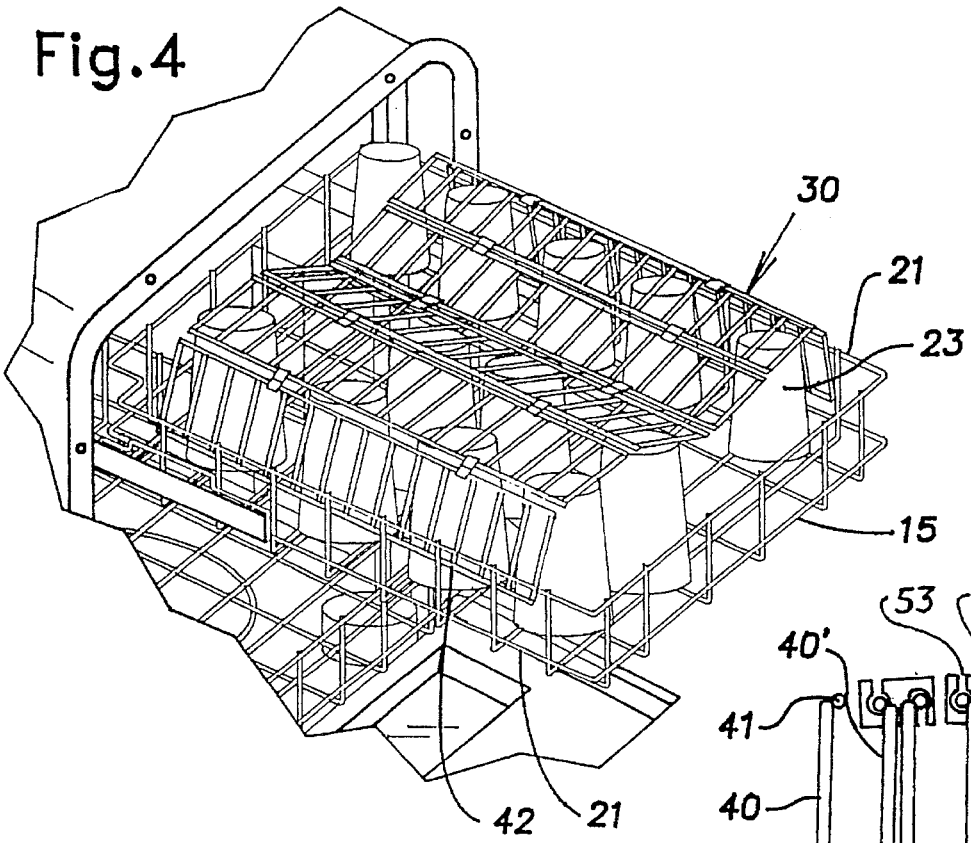
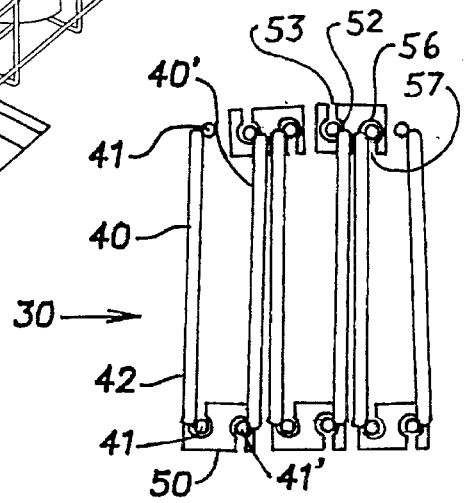
Fig.6
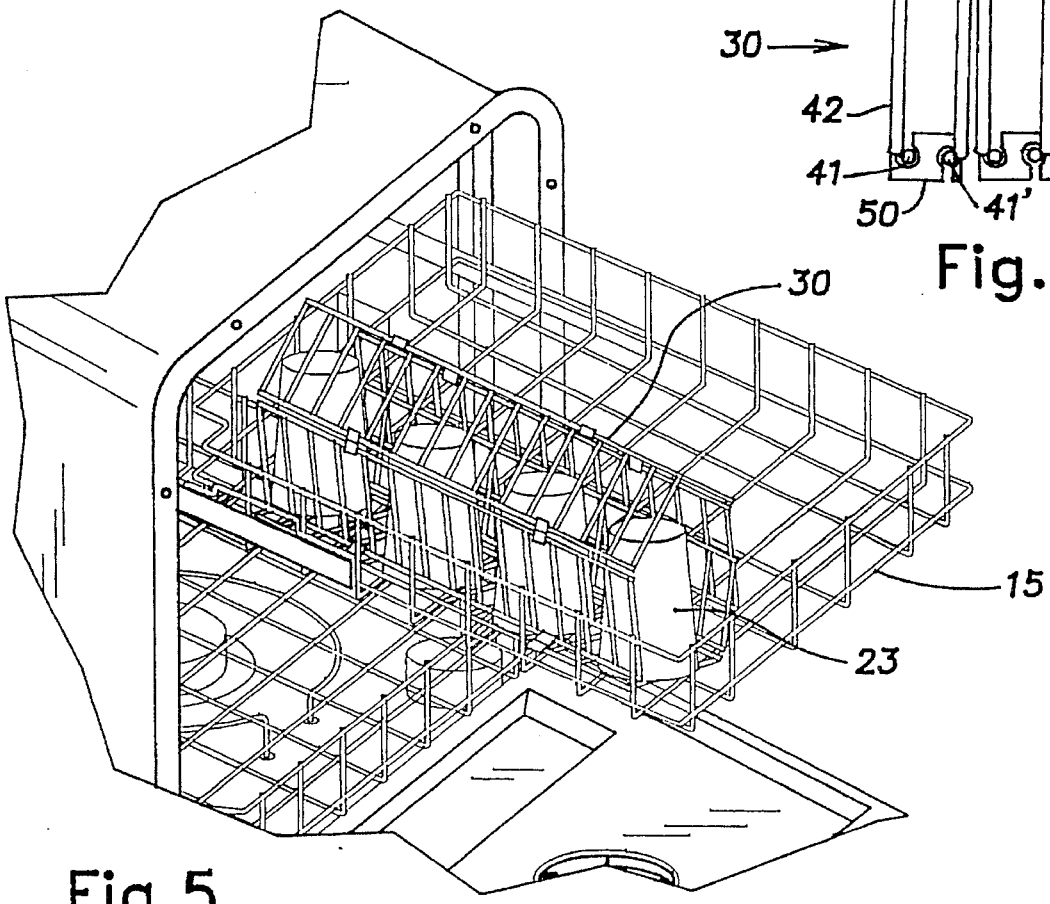
Fig.5

PLASTICWARE RETAINER FOR USE IN AN AUTOMATIC DISHWASHER

BACKGROUND OF THE INVENTION

The present invention generally relates automatic dishwashers, and more specifically, to a retainer for preventing movement of lightweight articles in an upper rack of a dishwasher.

A dishwasher generally has upper and lower racks which are slidably mounted to tracks fixed to inner sides of the dishwasher. The racks are pulled out for easy loading of dishes. Cups, glasses, and other containers are normally placed upside down along the racks for washing so that they will not fill with water. When the racks are loaded with dishes, the racks are pushed back into the dishwasher, the door is closed, and the washing cycle is initiated.

During the washing cycle, high pressure streams of water are upwardly projected against the dishes in the racks. In many cases, the force of the projecting water is strong enough to dislodge lightweight articles such as plastic cups. If dislodged to a right-side up position, the lightweight article fills with water. The weight of the water prevents the right-side up article from dislodging again to the upside down position to dump the water. The water therefore, remains in the article for the entire wash cycle and prevents the inside of the article from being properly cleaned. When the rack is pulled out and the dishes unloaded, the unclean water can spill out of the right-side up article onto clean dishes in the lower rack below.

An additional problem with unrestrained dishes in an automatic dishwasher is the melting of plastic articles. Lightweight plastic articles are frequently dislodged by the force of the projecting water and come to rest near a heating element. The heating element melts or reshapes the plastic articles to render them unusable.

Means for retaining articles in a dishwasher rack during washing are known in the prior art. For example, U.S. Pat. No. 3,935,958 discloses an enclosure for washing eating utensils in a dishwasher. The enclosure is provided with compartments for holding the utensils and hinged rigid covers for closing the compartments. A handle is provided to lift the enclosure from a horizontal loading position outside the dishwasher to an upright washing position in the dishwasher. See also U.S. Pat. No. 4,058,233 for a related utensil enclosure for a dishwasher having a rigid lid. U.S. Pat. Nos. 4,830,200, 4,748,993, and 4,732,291 also disclose enclosures, having pivotally mounted rigid covers, specifically for holding baby bottle parts in a dishwasher.

U.S. Pat. No. 3,612,285 discloses a dishwasher rack having a pivotally mounted retainer. The retainer has spaced apart sides and a crossbar connecting the sides at their outer ends. The sides are pivotally mounted to the rack at their inner ends. The crossbar comprises a succession of recessed sections that by gravity embrace inverted stemware, or rest on top of articles such as plastic cups or glasses, to prevent them from being displaced by the force of upwardly projecting water. U.S. Pat. No. 3,752,322 discloses a similar dishwasher rack comprising a means for positively retaining a pivotable retainer at a plurality of positions to press against lightweight articles.

U.S. Pat. No. 3,934,728 discloses a dishwasher rack providing a secondary rack which is pivotally mounted to a base rack. The secondary rack is movable between a vertical storage position perpendicular to the rack, and a horizontal position overlaying the base rack. In the horizontal position, the secondary rack provides an extra rack for supporting small items. Additionally, the secondary rack encloses a portion of the base rack that can be used for small items. U.S. Pat. No. 5,205,419 also discloses a dishwasher rack providing a pivotally mounted secondary rack.

U.S. Pat. No. 5,121,843 discloses a restraining net for covering a dishwasher rack. The net is generally convex with a periphery corresponding to a dishwasher rack. Fasteners are provided for fastening the periphery of the net around the periphery of the dishwasher rack. U.S. Pat. Nos. 5,201,826 and 5,114,019 disclose similar restraining nets having an elastic periphery for holding the net around the periphery of the dishwasher rack.

Each of the aforementioned patents are incorporated herein in their entirety by reference.

The aforementioned prior art retaining means are not adapted to accommodate varying types of loads by covering either substantially the entire dishwasher rack or a portion thereof. The enclosures and retainers pivotally mounted to the rack do not adequately retain varying size articles or an entire rack of lightweight articles. The retaining nets are difficult and time consuming to install and remove, and cover the entire dishwasher rack regardless of the number of lightweight articles being washed. Therefore, there is a need in the art for an improved retaining means. Moreover, there is a need in the art for a retaining means that is adaptable to varying types of loads, and easily installed and removed.

SUMMARY OF THE INVENTION

The present invention provides a retainer that solves the problem of lightweight articles being dislodged from a dishwasher rack by a force of upwardly projecting washing liquid during washing. The disadvantages of the prior art are overcome by providing an easily installed retainer that adapts to loads having varying sized articles or a varying number of lightweight articles.

According to the invention, there is provided a plurality of perforate, generally rigid panel members and connectors for pivotally interconnecting the panel members. The connectors allow each panel member to rotate or pivot about an axis parallel to a side of an adjacent panel member to which the panel member is connected. The retainer, therefore, is generally rigid due to the rigidity of the panel members and foldable to an upper shape or profile of the lightweight articles due to the pivotability of the panel members. The panel, under the force of gravity, overlies the lightweight articles in the dishwasher rack and retains the articles in the dishwasher rack.

The retainer of the present invention is easily installed or removed because it simply overlies the articles in the dishwasher rack. The retainer is also adaptable to varying types of loads. The foldable nature of the panel allows the panel to generally form to varying sized and shaped articles in the dishwasher rack and to be easily folded for storage when not in use. Additionally, the panel can be partially folded or collapsed to cover and retain dishes in a portion of the dishwasher rack when only a few lightweight items are being washed. Furthermore, because the retainer can be used with a standard dishwasher rack and is not attached to the rack, it can be easily added to existing dishwashers or replaced if necessary.

BRIEF DESCRIPTION OF THE DRAWINGS

The present invention will hereafter be described with reference to the drawing figures, wherein:

FIG. 4 is a perspective view of a dishwasher upper rack with the retainer positioned perpendicular to the position of the retainer of FIG. 1;

FIG. 5 is a perspective view of the retainer positioned for partial coverage of the dishwasher upper rack; and FIG. 6 is an elevational view of the retainer folded or collapsed in an accordion-like manner for storage.

DETAILED DESCRIPTION OF THE PREFERRED EMBODIMENTS

Figure 1:
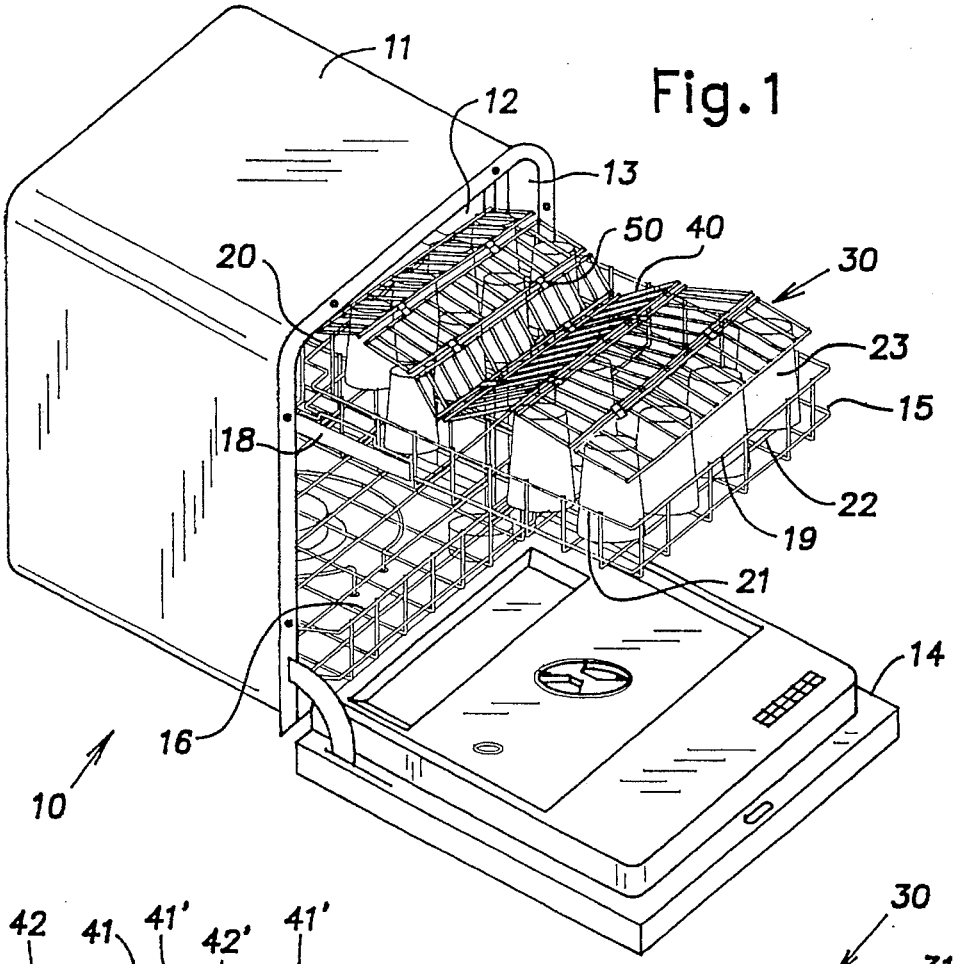
FIG. 1 is a perspective view of a dishwasher with a retainer installed in the upper rack.

A front loading automatic dishwasher 10, shown in FIG. 1, includes a tank 11 defining a cleaning chamber 12 having a front opening 13. A door 14 is hingedly mounted at the bottom of the front opening 13 for pivotal movement about a bottom edge, as is conventional. The door 14 moves from a vertical closed position (not shown) to a horizontal open position (shown in FIG. 1). Supported within the chamber 12 are an upper rack 15 and a lower rack 16 for supporting soiled articles 23 for cleaning by the dishwasher 10.

The lower rack 16 is supported within the chamber 12 by suitable tracks and is adapted to be rolled out onto the door 14 in its open position for loading and unloading. The upper rack 15 is supported within the chamber by a pair of conventional telescopic tracks 18. The upper rack 15 is movable from a retracted position within the chamber 12 (not shown) and a fully extended position overlying the door 14 in its open position (shown in FIG. 1) for loading and unloading.

The racks 15, 16 are generally basket-shaped having a front 19, a back 20, opposed sides 21, and a bottom 22. The racks 15, 16 are formed of segmental wire-frame construction wherein wire segments are spaced sufficiently closely to prevent stored articles 23 from passing therethrough, while exposing the articles 23 to an upwardly projecting washing liquid for cleaning.

As shown in FIG. 1, soiled articles 23 are positioned within the upper rack 15, which include light weight articles 23 such as plastic cups. The articles 23 are placed in the upper rack 15 in an upside down position for cleaning by the upwardly projecting washing liquid. A plasticware retainer 30, overlies the articles 23 to hold the articles 23 in the upper rack 15 against the upwardly projecting washing liquid. The plasticware retainer 30 comprises a plurality of perforate, generally rigid panel members 40, and connectors for pivotally interconnecting 50 the panel members 40.

Figure 2:
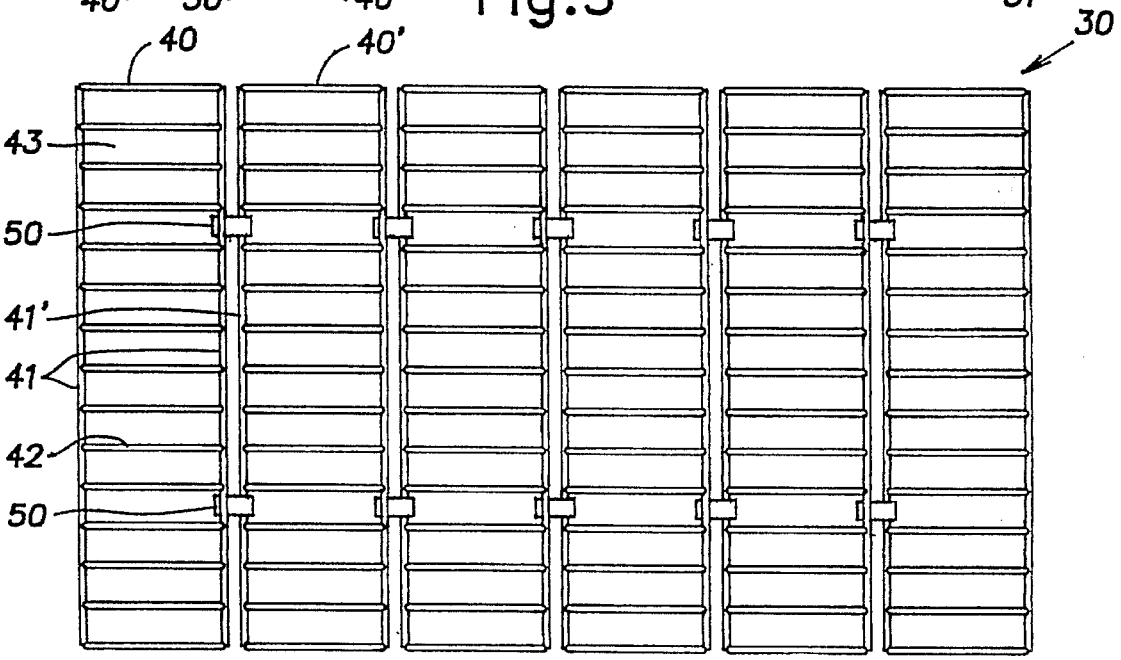
FIG. 2 is a plan view of the retainer.

The panel members 40 are preferably formed of segmental wire-frame construction consisting of wire segments 41, 42, as shown in FIG. 2, so that water may freely flow through the retainer 30 during washing and rinsing cycles of the dishwasher 10. Preferably, the wire segments 41, 42 comprise steel wire coated with a vinyl or plastic material to minimize rust of the steel wire and scratching of the retained articles 23. The vinyl or plastic material must have sufficient heat resistant qualities to withstand temperatures in the dishwasher 10 which can reach approximately 140 degrees fahrenheit. The panel member 40 wire-frame construction and materials are of the type used for the upper and lower racks 15, 16 as known in the art. The wire segments 41, 42 may comprise other materials, such as solid plastic or vinyl, as long as they have sufficient qualities relating to corrosion resistance, heat resistance, strength, weight and rigidity.

In the preferred embodiment, the panel members 40 comprise two longitudinally extending segments 41 and fifteen transversely extending segments 42. The longitudinally extending segments 41 are substantially parallel and spaced-apart by the length of the transversely extending segments 42. The length of the longitudinally extending segments 41 is 15½ inches which is slightly less than a length of the upper rack front 19 and back 20. This length allows the panel member 40 to easily fit within the upper rack 15 yet cover the full front length of the upper rack 15. The transversely extending segments 42 are substantially parallel, equally spaced-apart, and perpendicular to the longitudinally extending segments 41. Disposed in such an arrangement, the segments 41, 42 define substantially rectangular openings 43 therebetween. In the preferred embodiment, the length of the transverse segments 42 is approximately 3¼ inches so that six panel members 40 are required to fully cover the upper rack 15. This transverse length of a panel member 40 is approximately the diameter of an average size plastic cup 23.

It will be understood that the panel members 40 formed of wire-frame construction can have segments 41, 42 of other quantities, lengths, spacings or orientations as long as the washing liquid can adequately pass through the panel members 40 and the articles 23 are adequately retained. It will also be understood that the panel members 40 can be formed of other perforate constructions or shapes known to those skilled in the art. For example, but not limited to, a solid panel having a plurality of openings or apertures therein, or a mesh-like panel.

Figure 3:
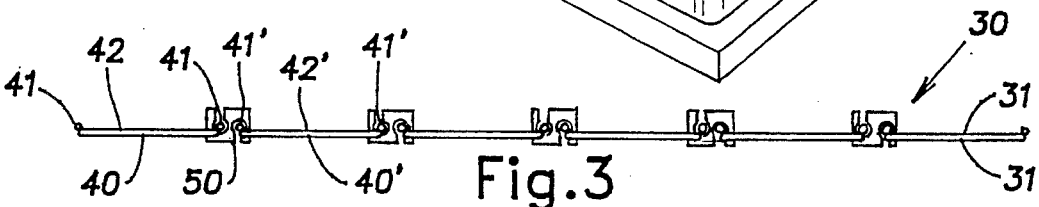
FIG. 3 is an elevational view of the retainer of FIG. 2.

As shown in FIGS. 2, 3 and 6, the preferred connectors for pivotally interconnecting 50 the panel members 40 are blocks 50. Preferably, the blocks 50 are made of polypropylene, however, the blocks may comprise other materials, such as other plastics, vinyl, nylon, or coated metals as long as they have sufficient qualities relating to corrosion resistance, heat resistance, and strength. The blocks 50 are machined from a solid block of material. As best seen in FIGS. 3 and 6, two parallel openings 52, 56 are drilled through each block 50. Slots 53, 57 are cut extending from the openings 52, 56 to opposed side surfaces of the block 50 along the full thickness of the block 50 to form an "S"-shape. The slots 53, 57 are sized to allow insertion of the longitudinally extending segments 41 into the openings 52, 56. Preferably, the slots 53, 57 are sized such that the panel members 40 are not easily separated once connected. The openings 52, 56 are sized to allow free rotation of the longitudinally extending elements within the openings 52, 56. The openings 52, 56 are spaced apart such that the panel members 40 connected by the block 50 can fully pivot or rotate. The block 50 thickness is dimensioned to fit between transversely extending segments 42 of the panel members 40.

It will be understood that other connectors for pivotally connecting 50 the panel members 40 known to those skilled in the art can be used, for example, but not limited to, hinges bands, straps, wires, or links.

As shown in FIGS. 2 and 3, the retainer 30 comprises six panel members 40 successively positioned side-by-side such that adjacent longitudinally extending segments 41, 41' are substantially parallel. In this arrangement, the combined length of the panel members 40 in the transverse direction is approximately equal to a length of the dishwasher rack sides 21. Other quantities of panel members 40 can be used depending on the transverse length of the panel members 40, and the amount of area desired to be covered.

Each panel member 40 is pivotally connected to the adjacent panel member 40' by two of the blocks 50 such that each panel member 40, 40' is able to freely and fully pivot or rotate in either direction. The longitudinally extending segment 41 of the panel member 40 is held within the first block opening 52 and the adjacent longitudinally extending segment 41' of the adjacent panel member 40' is held within the second block opening 56. The blocks 50 must be spaced far enough apart to hold the longitudinally extending members 41, 41' of the adjacent panel members 40, 40' substantially parallel.

It will be understood that panel members of other shapes and sizes can be interconnected in other patterns, ways, or along different sides. Additionally, the panel members can pivot about a different axis, for example, but not limited to, the panel members can be pinned at the center of their transverse ends to pivot about a central longitudinal axis.

Because the panel members 40 are connected to fully pivot or rotate in either direction, the retainer 30 can be folded or collapsed from a fully expanded state, shown in FIGS. 2 and 3, to a folded state, shown in FIG. 6. In the fully expanded state, the retainer 30 forms opposed substantially planar support faces 31, as shown in FIG. 3. The retainer 30 is rigid in the longitudinal direction, however, in the transverse direction the retainer 30 is foldable due to the pivotability of the panel members 40. As the panel members 40 pivot or rotate, the retainer 30 generally forms to articles 23 having irregular heights or shapes in the transverse direction, while remaining rigid in the longitudinal direction to retain the articles 23, as shown in FIGS. 1, 4, and 5. By decreasing the transverse length of the panel members 40 and increasing the number of panel members 40, the foldability of the retainer 30 in the transverse direction can be increased. Likewise, by increasing the transverse length of the panel members 40 and decreasing the number of panel members 40, the foldability of the retainer 30 in the transverse direction can be decreased.

Because the blocks 50 allow the panel members 40 to fully rotate or pivot about the adjacent panel members 40' in either direction, the retainer 30 can be collapsed in an accordion-like manner to a folded state, as shown in FIG. 6. Folded in this manner, the panel members 40 are stacked one upon another. The retainer 30, therefore, requires a minimum amount of space for storage. Additionally, because each panel member 40 can fully rotate or pivot, the retainer 30 can be folded into many other configurations (for example see FIG. 5).

Alternatively, the connectors or blocks 50 can be adapted using conventional means to be detachable so that the panel members 40 can be separated and stacked for storage. The ability to separate the panel members 40 also enables the size of the retainer 30 to be adjusted for different coverage of the dishwasher upper rack 15.

As shown in FIG. 1, the soiled articles 23 are first placed in the dishwasher racks 15, 16. When the articles 23 are loaded, the retainer 30 is taken from storage in the folded state and is expanded. The retainer 30 is then raised and positioned above the dishwasher upper rack 15 with the retainer planar faces 31 parallel with the upper rack bottom 22 and the longitudinal extending segments 41 parallel with the upper rack front 19 and back 20. Either planar face 31 of the retainer 30 can be facing downward. The retainer 30 is then lowered until the downward facing planar face 31 contacts the top of the articles 23 in the upper rack 15 or the upper rack 15 itself. The panel members 40 will freely rotate or pivot to generally conform to the shape of the articles 23 in the transverse direction of the retainer 30, as shown in FIG. 1. The retainer 30 is then released and under the force of gravity rests on the articles 23 or upper rack 15 and overlies the articles 23. The retainer 30 is of such size and shape to cover the entire dishwasher upper rack 15. The racks 15, 16 are pushed into the cleaning chamber 12, the door 14 is closed, and the washing cycle is initiated.

During the washing cycle the retainer 30 has sufficient weight and rigidity to retain the articles 23 in the upper rack 15 against the upwardly projecting washing liquid and prevent them from dislodging. After the washing cycle is completed, the door 14 is opened, and the upper rack 15 is pulled out, the retainer 30 is removed or temporarily folded back to allow unloading of the clean articles 23. Once fully removed, the retainer 30 is collapsed to the folded state for storage. When desired, the retainer 30 can be reinstalled in the above described manner.

Because of the size and shape of the retainer 30, it is not necessary to orient the retainer 30 in the above described direction. The retainer 30 can also be installed with the longitudinally extending elements 41 parallel to the upper rack sides 21, as shown in FIG. 4. This versatility allows the retainer 30 to be quickly installed with a minimum of attention to orientation. In addition, this allows the articles 23 to be placed in the upper rack 15 without regard to location.

If only a few lightweight articles 23 need to be retained in the dishwasher upper rack 15, the retainer 30 can be folded for partial coverage of the upper rack 15. For example, the retainer 30 can be folded in half when coverage of only half of the upper rack 15 is required. As seen in FIG. 5, the retainer 30 can also be folded to form an enclosure for several articles 23.

Although particular embodiments of a retainer for holding lightweight articles in a dishwasher have been described in detail, it will be understood that the invention is not limited correspondingly in scope, but includes all changes and modifications coming within the spirit and terms of the claims appended hereto.

What is claimed is:

1. A retainer for holding lightweight articles in a dishwasher rack against a force of upwardly projecting liquid, said retainer comprising a plurality of perforate, generally rigid panel members, and connectors for pivotally interconnecting said panel members to form a generally flexible panel, each of said panel members pivoting about an axis substantially parallel with a side of each of said panel members pivotally connected thereto, wherein said panel members pivot such that said panel generally conforms to and overlies said lightweight articles during washing for retaining said articles in said dishwasher rack against said force of said upwardly projecting liquid.

2. The retainer of claim 1, wherein said panel members are of segmental wire frame construction.

3. The retainer of claim 2, wherein said panel members comprise at least two substantially parallel spaced-apart longitudinally extending segments and a plurality of spaced-apart transversely extending segments disposed in an arrangement for defining substantially rectangularly shaped openings therebetween.

4. The retainer of claim 3, wherein said panel elements are pivotally interconnected along said longitudinally extending segments to fold said retainer in an accordion-like manner for storing said retainer.

5. The retainer of claim 1, wherein said panel members are detachably connected and stackable for storing said retainer.

6. The retainer of claim 4, wherein said pivotally interconnecting connectors comprise at least two spaced-apart blocks, said blocks defining openings through which adjacent longitudinally extending segments of said adjacently connected panel members extend.

7. The retainer of claim 6, wherein said blocks define slots extending from sides of said blocks to said openings for inserting said longitudinally extending segments into said openings.

8. A retainer for holding lightweight articles in a dishwasher rack against a force of upwardly projecting washing liquid, said retainer comprising a plurality of rectangularly shaped generally rigid panel members, and at least two spaced-apart blocks for pivotally connecting adjacent panel members, said panel members comprising at least two substantially parallel spaced-apart longitudinally extending segments and a plurality of spaced-apart transversely extending segments disposed in an arrangement for defining substantially rectangular openings therebetween, said blocks defining openings through which adjacent longitudinally extending elements of said connected adjacent panel members extend so that said panel members pivot about a longitudinal axis to generally conform to and overlie said articles during washing for retaining said articles in said dishwasher rack against said force of said upwardly projecting washing liquid, said panel members fully pivoting to fold said retainer in an accordion-like manner for storing.

9. A retainer in combination with a dishwasher rack for holding lightweight articles against a force of upwardly projecting washing liquid, said dishwasher rack being perforate and basket-shaped having a front a back, opposed sides, and bottom for supporting said lightweight articles, said retainer comprising a plurality of perforate, generally rigid panel members, and connectors for pivotally interconnecting said panel members to form a generally flexible panel, each of said panel members pivoting about an axis substantially parallel with a side of each of said panel members pivotally connected thereto, wherein said panel members pivot such that said panel generally conforms to and overlies said lightweight articles during washing for retaining said articles in said dishwasher rack against said force of said upwardly projecting liquid.

10. The retainer of claim 9, wherein said panel members are of segmental wire frame construction.

11. The retainer of claim 10, wherein said panel members comprise at least two substantially parallel spaced-apart longitudinally extending segments and a plurality of spaced-apart transversely extending segments disposed in an arrangement for defining substantially rectangularly shaped openings therebetween.

12. The retainer of claim 11, wherein said panel elements are pivotally interconnected along said longitudinally extending segments to fold said retainer in an accordion-like manner for storing said retainer.

13. The retainer of claim 12, wherein said pivotally interconnecting connectors comprise at least two spaced-apart blocks, said blocks defining openings through which adjacent longitudinally extending segments of said adjacently connected panel members extend.

14. The retainer of claim 13, wherein said blocks define slots extending from sides of said blocks to said openings for inserting said longitudinally extending segments into said openings.

15. The retainer of claim 13, wherein said longitudinally extending segments have a length slightly less than said dishwasher rack front and back.

16. The retainer of claim 15, wherein said panel members expand to a transverse length generally equal to a length of said dishwasher rack sides.

17. The retainer of claim 9, wherein said panel members expand to an area substantially equal an area of said dishwasher rack.

* * * * *